US011530515B2

(12) United States Patent
McClure Wightwick

(10) Patent No.: US 11,530,515 B2
(45) Date of Patent: Dec. 20, 2022

(54) PAPER MAKING MACHINE AND A METHOD OF CUTTING A FIBROUS WEB IN A PAPER MAKING MACHINE

(71) Applicant: Valmet Aktiebolag, Sundsvall (SE)

(72) Inventor: Scott McClure Wightwick, Safety Beach (AU)

(73) Assignee: VALMET AKTIEBOLAG, Sundsvall (SE)

( * ) Notice: Subject to any disclaimer, the term of this patent is extended or adjusted under 35 U.S.C. 154(b) by 576 days.

(21) Appl. No.: 16/621,484

(22) PCT Filed: Jun. 7, 2018

(86) PCT No.: PCT/SE2018/050592
§ 371 (c)(1),
(2) Date: Dec. 11, 2019

(87) PCT Pub. No.: WO2018/236264
PCT Pub. Date: Dec. 27, 2018

(65) Prior Publication Data

US 2021/0148050 A1 May 20, 2021

(30) Foreign Application Priority Data

Jun. 21, 2017 (SE) ..... 1750798-9

(51) Int. Cl.
*B65H 35/00* (2006.01)
*D21F 7/00* (2006.01)
(Continued)

(52) U.S. Cl.
CPC ..... *D21F 7/006* (2013.01); *B08B 17/02* (2013.01); *B26F 3/004* (2013.01); *B65H 18/16* (2013.01);
(Continued)

(58) Field of Classification Search
CPC ... D21F 7/00; D21F 7/006; D21F 1/34; B26D 7/00; B26F 3/00; B26F 3/004;
(Continued)

(56) References Cited

U.S. PATENT DOCUMENTS 4,182,170 A * 1/1980 Grupp ..... D21F 7/04 83/53
5,360,179 A 11/1994 Vesterinen et al.
(Continued)

FOREIGN PATENT DOCUMENTS

CA 2482065 A1 3/2005
CA 2487208 A1 6/2005
(Continued)

OTHER PUBLICATIONS

International Searching Authority, International Search Report and Written Opinion for International Application No. PCT/SE2018/050592, dated Jun. 28, 2018, (13 pages), Sweden.
(Continued)

*Primary Examiner* — Leslie A Nicholson, III
(74) *Attorney, Agent, or Firm* — Alston & Bird LLP

(57) ABSTRACT

The invention relates to a paper making machine (1) comprising a forming section (2) in which a fibrous web (W) can be formed, a drying section (5) in which a formed fibrous web (W) can be dried; and a reel-up (11) on which a dried fibrous web (W) can be wound into a roll (12). The paper making machine (1) is arranged to carry a fibrous web (W) in the machine direction (MD) along a predetermined path (P) and the paper making machine (1) has at least one water jet cutting device (17, 18, 19) arranged to cut the fibrous web (W) that is moving in the machine direction (MD) such that the fibrous web (W) is divided into at least one waste part (23*a*, 23*b*, 30) and a remaining part (24, 29). The paper making machine (1) is arranged to direct the at least one
(Continued)

waste part (23*a,* 23*b,* 30) away from the predetermined path (P) and to convey the remaining part (24, 29) further in the machine direction (MD) along the predetermined path (P). The paper making machine (1) further comprises a blowing device (20, 21, 22) arranged to blow gas or air against the water jet cutting device (17, 18, 19) in a direction toward the remaining part of the fibrous web (24, 29) such that fiber particles that have been released by the cutting action of the water jet cutting device (17, 18, 19) are blown onto the surface (25) of the remaining part (24, 29) of the fibrous web (W) and follow the remaining part (24, 29) of the fibrous web along the predetermined path (P). The invention also relates to a method in which gas or air is blown in a direction toward the remaining part of the web such that fiber particles that have been released by the cutting action of the water jet cutting device (17, 18, 19) are blown onto the surface (25) of the remaining part (24, 29) of the fibrous web (W). The stream of air or gas is given a shape which is circular cylindrical or conical and expanding in the direction in which the stream moves.

10 Claims, 13 Drawing Sheets

(51) Int. Cl.

| | |
|---|---|
| ***B08B 17/02*** | (2006.01) |
| ***B26F 3/00*** | (2006.01) |
| ***B65H 18/16*** | (2006.01) |
| ***B65H 35/04*** | (2006.01) |

(52) U.S. Cl.
CPC ..... *B65H 35/04* (2013.01); *B65H 2515/12* (2013.01); *B65H 2701/1924* (2013.01)

(58) Field of Classification Search
CPC ..... B65H 18/16; B65H 2515/12; B65H 2701/1924; B08B 17/02
See application file for complete search history.

(56) References Cited

U.S. PATENT DOCUMENTS

| | | | | |
|---|---|---|---|---|
| 5,901,918 | A | 5/1999 | Klerelid et al. | |
| 6,001,219 | A | 12/1999 | Caspar | |
| 6,176,975 | B1 | 1/2001 | Andersson et al. | |
| 6,237,948 | B1 | 5/2001 | Maschek et al. | |
| 6,325,896 | B1 | 12/2001 | Hultcrantz et al. | |
| 6,327,948 | B1 * | 12/2001 | Tuori | B26D 7/1854 83/53 |
| 6,942,758 | B2 | 9/2005 | Juppi et al. | |
| 9,003,936 | B2 * | 4/2015 | Chillman | B26F 3/004 83/22 |
| 9,217,225 | B2 | 12/2015 | Michaud | |
| 9,469,495 | B2 * | 10/2016 | Caspar | B65H 19/265 |
| 9,511,968 | B2 * | 12/2016 | Malmqvist | B65H 19/283 |
| 9,969,586 | B2 * | 5/2018 | Malmqvist | B65H 20/06 |
| 2013/0220564 | A1 | 8/2013 | Michaud | |

FOREIGN PATENT DOCUMENTS

| | | | |
|---|---|---|---|
| CN | 203866643 | U | 10/2014 |
| CN | 204644771 | U | 9/2015 |
| CN | 105492353 | A | 4/2016 |
| CN | 205975197 | U | 2/2017 |
| EP | 0543788 | A1 | 5/1993 |
| EP | 0870583 | A2 | 10/1998 |
| EP | 2126203 | B1 | 6/2012 |
| EP | 2963176 | A1 | 1/2016 |
| EP | 2812486 | B1 | 2/2016 |
| JP | 2003-027387 | A | 1/2003 |
| WO | WO-1998/032919 | A1 | 7/1998 |
| WO | WO-2015/034413 | A1 | 3/2015 |

OTHER PUBLICATIONS

Chinese Office Action for Chinese Patent Application No. 201880041385.2, dated Dec. 2, 2020, (8 pages), China National Intellectual Property Administration, Beijing, China.

* cited by examiner

PAPER MAKING MACHINE AND A METHOD OF CUTTING A FIBROUS WEB IN A PAPER MAKING MACHINE

CROSS REFERENCE TO RELATED APPLICATIONS

This application is a National Stage Application, filed under 35 U.S.C. § 371, of International Application No. PCT/SE2018/050592, filed Jun. 7, 2018, which international application claims priority to and the benefit of Swedish Application No. 1750798-9, filed Jun. 21, 2017; the contents of both of which as are hereby incorporated by reference in their entireties.

BACKGROUND

Related Field

The present invention relates to a paper making machine that comprises at least one water jet cutting device for cutting a fibrous web. The invention also relates to a method of cutting a fibrous web in a paper making machine.

DESCRIPTION OF RELATED ART

During paper making in a paper making machine, the fibrous web which is running through the machine, and which will become a ready-dried paper web, is often subjected to cutting by water jet cutting devices. The cutting can be made for the purpose of trimming the edges of the fibrous web but also in connection with tail threading when a narrow tail is cut which is passed on to a following section of the paper making machine whereafter the narrow tail is widened until it has achieved full width. An example of a known apparatus for cutting an edge of a moving paper web is disclosed in U.S. Pat. No. 6,237,948. That document describes how a waterjet is utilized to cut off a longitudinal edge of a moving web. An air jet is guided to the cutting spot where cutting dust and coating peeling off the paper and coating dust are conveyed to a channel and into the channel by suction. U.S. Pat. No. 6,001,219 discloses a water jet edge trimming station for use in a papermaking machine. According to that patent, the water jet cutting apparatus has a positive air pressure chamber surrounding the nozzle head of the water jet to maintain an air flow over the nozzle head driving effluent backsplash away from the nozzle head. U.S. Pat. No. 6,942,758 discloses a method and equipment for tail threading in the dryer section of a paper machine. A tail is cut by a cutting device which may be a water cutter. A blow nozzle is arranged to provide a blow which turns the edge of the broke web away from the cutting point.

JP 2003027387-A discloses an arrangement in which an edge trimming nozzle with high pressure water is arranged to cut a wet paper web while the wet paper web is on a wire. An air nozzle is adapted to eject a fluid (air) to between the edge trimming nozzle and the wet paper web and the air nozzle is arranged described as being arranged outside in the wire widthwise direction. The air nozzle has an internal air passage and a slit portion extending in the same direction as the air passage. High pressure air is adapted to be supplied to the air passage. According to JP 2003027387-A, ejection of air through the air nozzle can prevent mist that occurs when nozzle-cutting the wet paper web on the wire from adhering to the edge trimming nozzle and a solid component of the mist will not adhere to the edge trimming nozzle.

It is an object of the present invention to provide a paper making machine and a method of cutting in which the reliability of the machine operation is improved.

Brief Summary

The inventive paper making machine comprises a forming section in which a fibrous web can be formed, a drying section in which a formed fibrous web can be dried and a reel-up on which a dried fibrous web can be wound into a roll. The paper making machine has a machine direction which is defined as the direction from the forming section toward the reel-up. The paper making machine is arranged to carry a fibrous web in the machine direction along a predetermined path. The paper making machine has at least one water jet cutting device arranged to cut the fibrous web that is moving in the machine direction such that the fibrous web is divided into at least one waste part and a remaining part and the paper making machine is arranged to direct the at least one waste part away from the predetermined path (preferably directed downwards) and to convey the remaining part further in the machine direction along the predetermined path. The paper making machine further comprises a blowing device arranged to blow gas or air in the area of the at least one water jet cutting device. The blowing device is arranged to blow gas or air against the water jet cutting device in a direction toward the remaining part of the fibrous web such that fiber particles that have been released by the cutting action of the water jet cutting device are blown onto the surface of the remaining part of the fibrous web and follow the remaining part of the fibrous web along the predetermined path. The blowing device has a nozzle with an exit opening (an outlet for the air or gas that is blown from the blowing device) through which the air or gas is ejected in a stream. The nozzle (and its exit opening) is preferably oriented at an angle to the machine direction such that the stream of air or gas that is blown out of the exit opening is directed in its entirety at an angle to the machine direction. According to the invention, the nozzle of the blowing device is designed to a create a circular cylindrical or cone-shaped stream of air or gas toward the water jet cutting device.

Suitably, the paper making machine may have a frame that is arranged to support rolls that extend from a first side of the paper making machine to a second side of the machine in a cross-machine direction that is perpendicular to the machine direction.

In one embodiment of the inventive paper making machine, the paper making machine comprises a first water jet cutting device which is placed in the forming section adjacent the first side of the frame and arranged to cut a narrow edge strip from the fibrous web and a second water jet cutting device which is placed in the forming section adjacent the second side of the frame and arranged to cut a narrow edge strip from the fibrous web such that, at the edges of the fibrous web, two edge strips are separated from a remaining part of the fibrous web. The remaining part of the fibrous web will then be located between the edge strips and be wider than the two edge strips together. In this embodiment, the paper making machine comprises a blowing device for each of the first and the second water jet cutting device and the blowing devices are arranged to blow gas or air against their respective water jet cutting device in a direction toward the remaining part of the fibrous web. In this way, fiber particles that have been released by the cutting action of the water jet cutting devices are blown onto the surface of the remaining part of the fibrous web and follow the remaining part of the fibrous web along the predetermined path. In addition, the paper making machine may optionally comprise a through air drying cylinder and a foraminous wire arranged to run in a loop in a path which partially goes over a part of an outer circumference of the through air drying cylinder. The paper making machine may then be designed such that the forming section of the paper making machine comprises a forming fabric and the first and second water jet cutting devices are arranged to act on the fibrous web as the fibrous web travels on the forming fabric. The forming fabric may then be arranged to carry the remaining part of the fibrous web to the foraminous wire after the water jet cutting devices have acted on the fibrous web and the paper making machine may be configured to transfer the remaining part of the fibrous web onto the foraminous fabric and to guide the edge strips away from the predetermined path. At the same time, the paper making machine is so configured that the remaining part of the fibrous web is transferred to the foraminous wire such that the surface of the major portion onto which fiber particles have been blown comes into contact with the foraminous wire.

In another embodiment of the invention, the inventive paper making machine may comprise a moveable water jet cutting device that is capable of moving in the cross-machine direction such that a tail can be cut from the fibrous web for the purpose of threading. In this embodiment, the paper making machine is arranged to convey the tail further in the machine direction along the predetermined path while the rest of the fibrous web is directed away from the predetermined path. A blowing device will then be arranged to blow gas or air against the moveable water jet cutting device in a direction toward the tail such that fiber particles that have been released by the cutting action of the water jet cutting device are blown onto the surface of the tail and follow the tail along the predetermined path.

The blowing device can take many different forms. However, in preferred embodiments of the invention, the at least one blowing device is an air amplifier. Both for the purpose of edge cutting and tail cutting, the blowing device can be an air amplifier.

The invention also relates to a method of cutting a fibrous web which is running along a predetermined path in a paper making machine in a machine direction. The fibrous web will then be running from a forming section in which the fibrous web is formed toward a reel-up where the fibrous web is wound to a roll after it has been dried. The inventive method comprises cutting the web by means of a water jet cutting device such that the fibrous web is divided into at least one waste part and a remaining part. The waste part is directed away from the predetermined path and the remaining part is conveyed further in the machine direction along the predetermined path. In the inventive method, air or gas is blown in the area of the water jet cutting device. The air or gas that that is blown in the area of the water jet cutting device is blown in a direction toward the remaining part of the fibrous web such that fiber particles that have been released by the cutting action of the water jet cutting device are blown onto the surface of the remaining part of the fibrous web and follow the remaining part of the fibrous web along the predetermined path. The air or gas is blown toward the water jet cutting device (17, 18, 19) in a stream of air or gas. Preferably, the stream of air or gas is in its entirety directed at an angle to the machine direction (MD). Embodiments are conceivable in which a part of the stream is not directed at an angle to the machine direction but preferably the entire stream or substantially the entire stream is directed at an angle to the machine direction. According to the invention, the stream of air or gas is given a shape which is circular cylindrical or conical and expanding in the direction in which the stream moves.

In preferred embodiments, the position of the blowing device relative to the water jet cutting device and/or the angle at which the nozzle of the blowing device (together with the exit opening of the nozzle) is directed toward the blowing device is/are adjustable According to one embodiment of the inventive method, a first water jet cutting device which is placed in the forming section adjacent the first side of the frame is used to cut a narrow edge strip from the fibrous web while a second water jet cutting device which is placed in the forming section adjacent the second side of the frame is used to cut a narrow edge strip from the fibrous web such that, at the edges of the fibrous web, two edge strips are separated from a remaining part of the fibrous web. The remaining part is located between the edge strips and is wider than the two edge strips together. Gas or air is blown against each of the first and the second water jet cutting device in a direction toward the remaining part of the fibrous web such that fiber particles that have been released by the cutting action of the water jet cutting devices are blown onto the surface of the remaining part of the fibrous web and follow the remaining part of the fibrous web along the predetermined path.

The paper making machine may comprise a through air drying cylinder and a foraminous wire is running in a loop along a path which partially goes over a part of an outer circumference of the through air drying cylinder. The forming section of the paper making machine comprises a forming fabric and, according to one embodiment of the inventive method, the first and second water jet cutting devices act on the fibrous web as the fibrous web travels on the forming fabric. The forming fabric then carries the remaining part of the fibrous web to the foraminous wire after the water jet cutting devices have acted on the fibrous web and the remaining part of the fibrous web is transferred onto the foraminous fabric while the edge strips are guided away from the predetermined path and the remaining part of the fibrous web is transferred to the foraminous wire such that the surface of the remaining part onto which fiber particles have been blown comes into contact with the foraminous wire.

In another embodiment of the inventive method, a water jet cutting device that is moveable in the cross-machine direction is used to cut a tail from the fibrous web for the purpose of threading. The tail will then be conveyed further in the machine direction along the predetermined path while the rest of the fibrous web forms a waste part that is directed away from the predetermined path. Gas or air will then be blown against the moveable water jet cutting device in a direction toward the tail such that fiber particles that have been released by the cutting action of the water jet cutting device are blown onto the surface of the tail and follow the tail along the predetermined path.

DETAILED DESCRIPTION OF VARIOUS EMBODIMENTS

Figure 1:
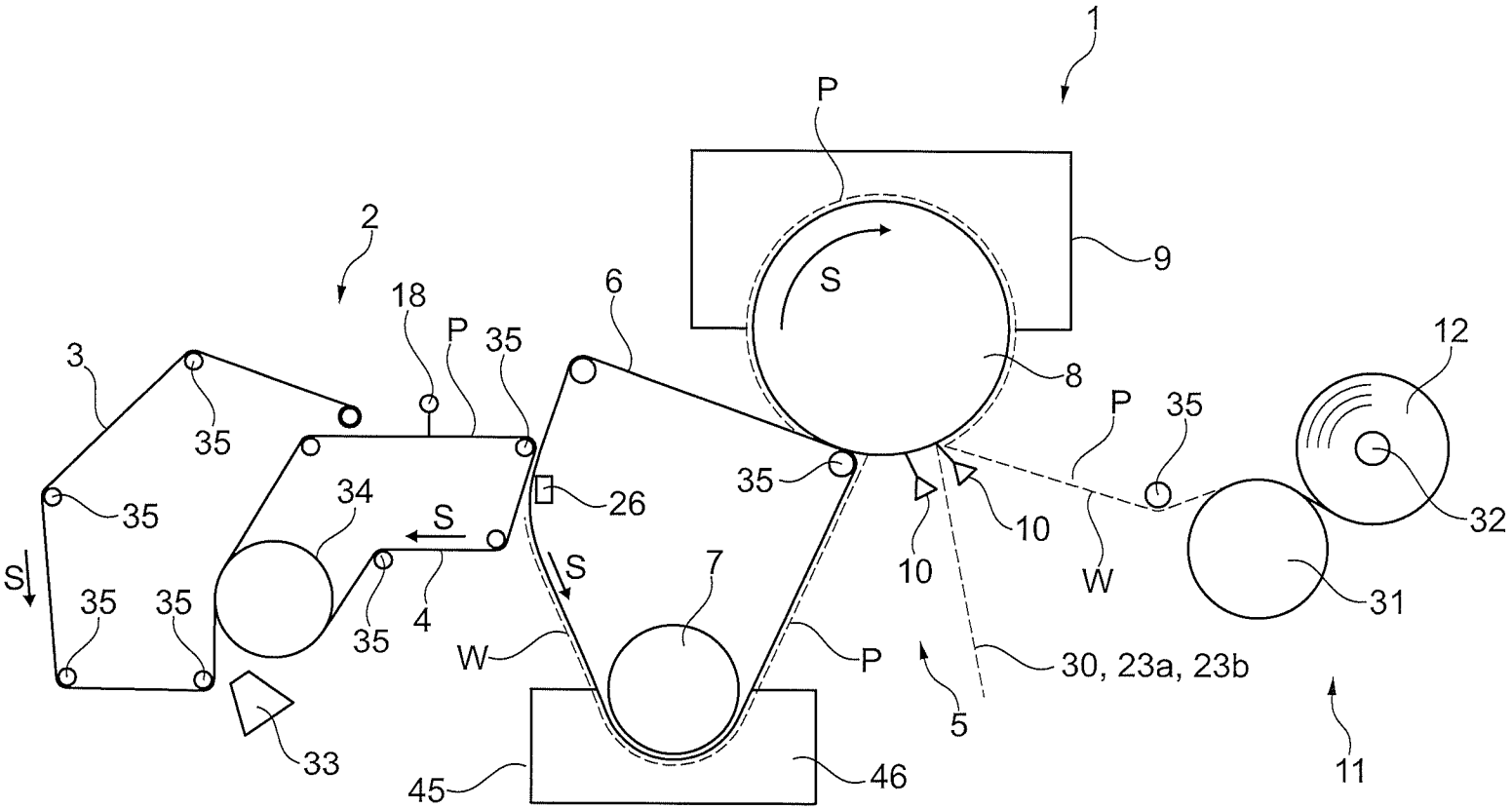
FIG. 1 is a schematic side view representing an embodiment in which the invention may be used.
Figure 6:
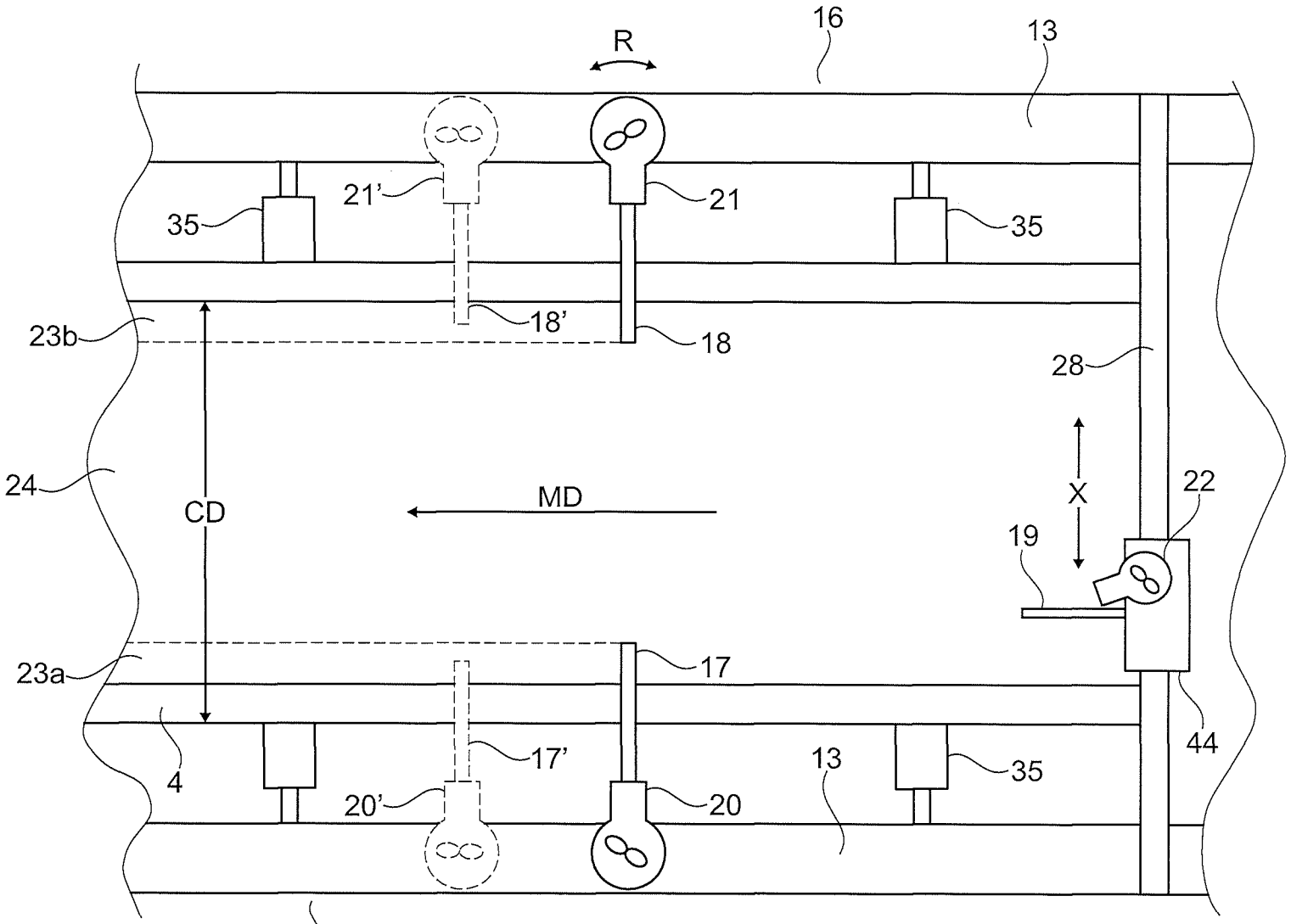
FIG. 6 is a view from above illustrating a possible embodiment of the invention when the invention is used for edge trimming.
Figure 7:
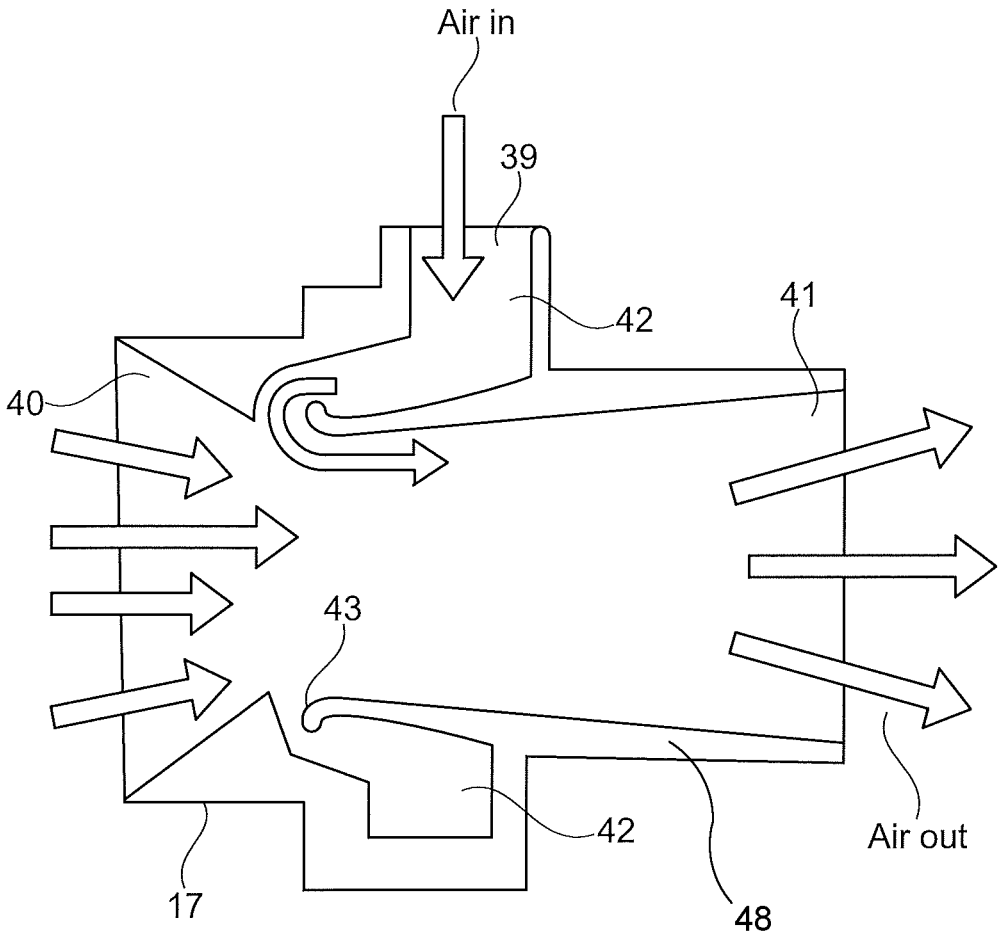
FIG. 7 is a schematic representation of a blowing device that can be used in advantageous embodiments of the invention.

With reference to FIG. 1, a paper making machine 1 is shown in which the invention may be embodied. The paper making machine 1 is in particular intended to be a tissue paper making machine intended for producing webs with a basis weigh that may be in the range of 15 g/m$^2$-40 g/m$^2$, and typical values may lie in the range of 15 g/m$^2$-30 g/m$^2$, but other values for basis weight are also conceivable and the invention is applicable also to other paper making machines than tissue paper making machines. The inventive paper-making machine as shown in FIG. 1 comprises a forming section 2 in which a fibrous web W can be formed, a drying section 5 in which a formed fibrous web W can be dried and a reel-up 11 on which a dried fibrous web W can be wound into a roll 12. In the embodiment of FIG. 1, the reel-up 11 is shown as a Pope-type reel-up with a supporting cylinder 31 and a core shaft 32 but it should be understood that any suitable reel-up may be used. For example, the reel-up 11 may be of the kind disclosed in U.S. Pat. No. 5,901,918. In the paper making machine 1, the machine direction MD is defined as the direction from the forming section 2 toward the reel-up 11, i.e. the direction in which a fibrous web W travels when the paper making machine 1 is operating to produce paper. The paper making machine 1 is arranged to carry a fibrous web W in the machine direction MD along a predetermined path P. In FIG. 1, the predetermined path P is indicated as the path that the fibrous web W follows as it moves from the forming section to the reel-up 11. With reference to FIG. 6, the paper making machine 1 may suitably further comprise a frame 13 that is arranged to support rolls 35 (for example guide rolls or press rolls) that extend from a first side 15 of the frame 13 to a second side 16 of the frame 13 in a cross-machine direction CD that is perpendicular to the machine direction MD. In FIG. 1, a drying section is generally indicated by the reference numeral 5. In the embodiment of FIG. 1, the drying section 5 comprises a through-air drying unit (a TAD unit) indicated by reference numeral 45 and a Yankee drying cylinder 8 that may be provided with a Yankee drying hood 9. A foraminous wire 6 runs in a loop supported by guide rolls 35 and carries the fibrous web through the through-air drying unit 45 to the Yankee drying cylinder 8. The TAD unit 45 comprises a TAD cylinder 7 and a hood 46. The Yankee drying cylinder 8 can be heated from the inside by hot steam as is known in the art of paper making. The Yankee drying cylinder 8 may be any kind of Yankee drying cylinder which is suitable for use in a tissue machine. For example, the Yankee drying cylinder 8 may be a Yankee drying cylinder of cast iron, but it may also be of the kind disclosed in European patent No. 2126203 and it may also be provided with heat insulation as disclosed in, for example, European patent No. 2812486. The Yankee drying hood 9 may advantageously be such a Yankee drying hood as is disclosed in European patent No. 2963176 but other Yankee drying hoods may also be considered. Embodiments without a Yankee drying hood 9 are also conceivable.

In the paper making machine 1 illustrated in FIG. 1, a fibrous web W is formed in the forming section 2. The forming section comprises a head box 33 arranged to inject stock in a gap between an outer forming fabric 3 that is supported by guide rolls 35 such that it may run in a loop and an inner forming fabric 4 that is likewise supported by guide rolls 35 to run in a loop. Inside the loop of the inner forming fabric 4, there is a forming roll 34 as is known in the art. The head box 33 may be any kind of suitable head box. For example, it may be of the kind disclosed in U.S. Pat. No. 6,176,975.

In the embodiment shown in FIG. 1, the fibrous web W is formed in the forming section and travels on the inner forming fabric 4 to a pick-up point where it is transferred to the foraminous wire 6 of the through-air drying unit (TAD unit) 45. A vacuum or suction unit 26 may be arranged inside the loop of the foraminous wire 6 to cause the fibrous web W to leave the inner forming fabric and instead follow the foraminous wire 6. The fibrous web is dried in the through-air drying unit 45 and then transferred to the outer surface of the Yankee drying cylinder where the final drying is carried out. The fibrous web is then creped off the surface of the Yankee drying cylinder 8 by a doctor 10 and passed to the reel-up 11. Optionally, there are two doctors 10 arranged to act against the Yankee drying cylinder 8 and the second doctor 10 may serve to remove remnants of fibers. The fibrous web may be passed to the reel-up in an open draw, but it may conceivably be supported, for example by an arrangement as disclosed in U.S. Pat. No. 6,325,896.

It should be understood that, in FIG. 1, the various fabrics 3, 4, 6 are running in the direction indicated by the arrows S and the Yankee drying cylinder 8 is rotating in the direction of arrow S indicated on the Yankee drying cylinder 8.

Figure 2:
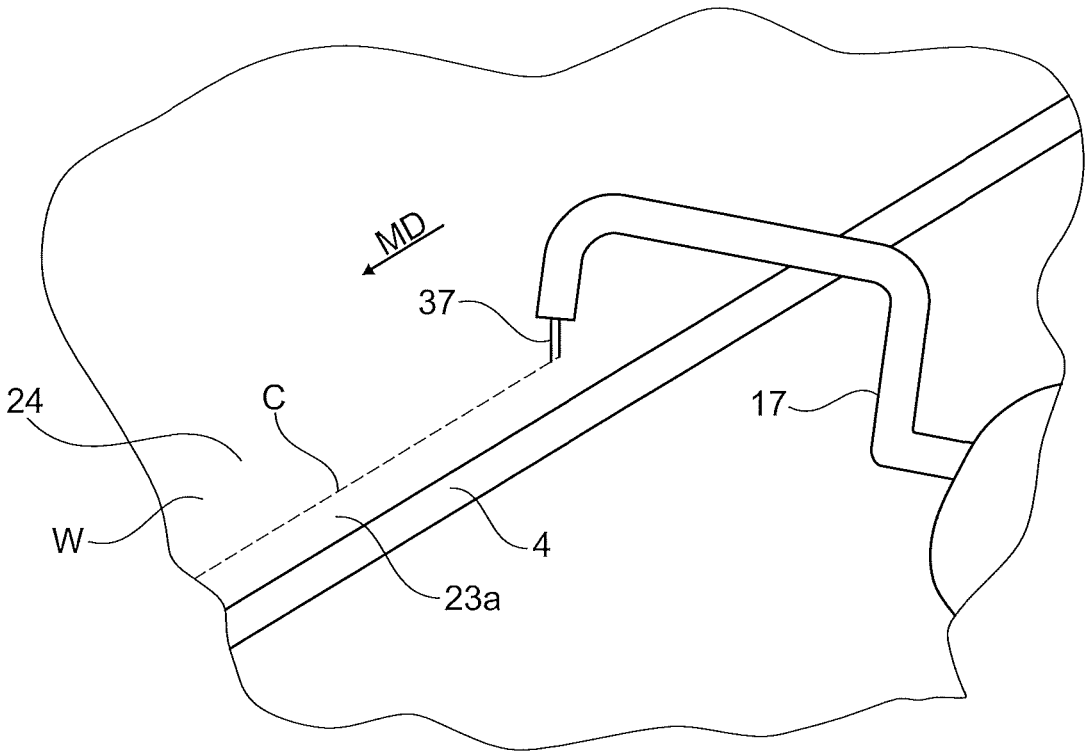
FIG. 2 is a perspective view showing the action of a water jet cutting device on a fibrous web.

With reference to FIG. 2, the paper making machine 1 has at least one water jet cutting device 17 that is arranged to cut the fibrous web W that is moving in the machine direction MD such that the fibrous web W is divided into at least one waste part 23*a* and a remaining part 24. In the embodiment of FIG. 2, the water jet cutting device 17 is located in the forming section 2 and acts against the newly formed fibrous web W when the fibrous web W is supported by the inner forming fabric 4. The water jet cutting device sends a jet 37 of water against the fibrous web such that the fibrous web is divided along the cut line C. In the position indicated in FIG. 2, the water jet cutting device 17 is intended to cut an edge strip and the waste part 23*a* is an edge strip that is being cut away in order to provide a fibrous web with a predetermined width and a clean and well-defined edge. The waste part 23*a* will, at some point, be directed away from the predetermined path of the fibrous web. This can be done where the fibrous web is creped off from the Yankee drying cylinder 8 but it can also be done at an earlier stage, for example at the transfer point of the fibrous web to the foraminous wire 6 or at the transfer to the Yankee drying cylinder 8. The removal of the waste part 23*a* is, as such, conventional technology with which the skilled person is familiar, and it does not need to be explained in detail. Preferably, the waste part 23*a* is directed downwards from the predetermined path P and into the pulper (not shown in the figures). While the waste part 23*a* is directed away from the predetermined path P, the remaining part 24 is conveyed further in the machine direction MD.

Figure 3:
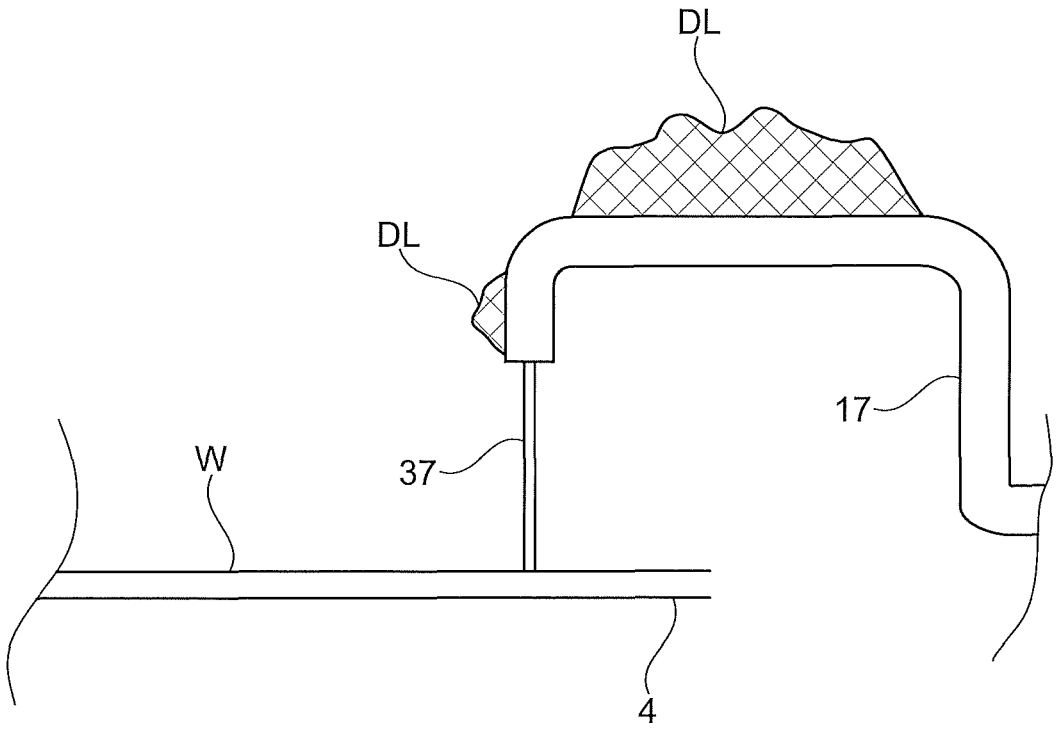
FIG. 3 is a schematic illustration of what may happen during operation of a water jet cutting device.
Figure 4:
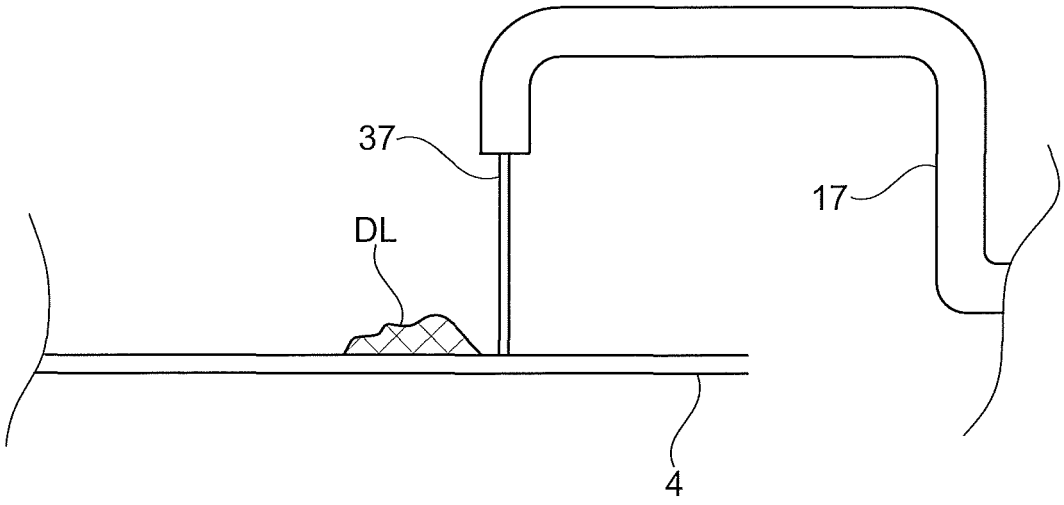
FIG. 4 is a figure similar to FIG. 3 and illustrating a technical problem that the invention seeks to solve.

A technical problem will now be explained with reference to FIG. 3 and to FIG. 4. When the water jet 37 cuts the fibrous web W, fiber particles will be released into the ambient air such that the air surrounding the water jet cutting device 17 will be constantly filled with small particles consisting of wet fibers. Some fiber particles will fall on the water jet cutting device 17 and build lumps DL of fiber material as indicated in FIG. 3. Now and then, such lumps DL will fall off from the water jet cutting device 17 and some such lumps DL may fall on the part of the fibrous web that is conveyed further in the machine direction MD. In addition, such lumps DL of fiber material may also build up on other parts of the paper making machine and fall down on the fibrous web W, even at locations downstream of the water jet cutting devices 17, 18. When such lumps DL land on the fibrous web, this may cause a number of disadvantages. The fibrous web W may be damaged, and the lumps DL may result in irregularities in the final product. Another problem may arise if the fibrous web W is to be transferred from the inner forming fabric 4 to a foraminous wire 6 as indicated in FIG. 1. A correct transfer to the foraminous wire 6 may become jeopardized and the fibrous web may be ripped apart. Therefore, it is desirable that the build-up of such lumps DL on the water jet cutting device 17 (and/or on other parts of the paper making machine) be prevented.

It has been proposed in JP 2003027387-A that an air nozzle can be used to eject air such that an air layer is formed below the edge trimming nozzle to prevent mist from adhering to the edge trimming nozzle. The inventor of the present invention has found that, while such an arrangement may remove some fibrous particles from the area of the trimming nozzle, a substantial portion of the mist which is laden with fibrous particles will not be affected by the air layer. In particular, the area where the mist is generated will not be affected. Moreover, the air layer in the area between the edge trimming nozzle and the web will (at best) have only a limited effect in the area of the edge trimming nozzle itself. As a consequence, fibrous particles can still accumulate into lumps on the trimming nozzle. The lumps can then fall down on the web and cause the problems explained above.

According to the invention, the above indicated problem is solved in a way that will now be explained with reference to FIG. 5. A blowing device 20 is arranged in the area of the water jet cutting device 17 and the blowing device 20 is arranged to blow gas or air in the area of the at least one water jet cutting device 17 against the water jet cutting device 17 in a direction toward the remaining part of the fibrous web 24 such that fiber particles 38 that have been released by the cutting action of the water jet cutting device 17 are blown onto the surface 25 of the remaining part 24 of the fibrous web W and follow the remaining part 24 of the fibrous web along the predetermined path P. The individual fiber particles 38 are so small that they will not have any significant impact on the fibrous web W or on the process in the paper making machine 1 and they will not cause any significant problems with transfer to the foraminous wire 6 or other machine components. If the fiber particles 38 land on the fibrous web W while the fibrous web is still in the forming section 2, they can easily be integrated into the fibrous web W since the fibrous web is still very wet at this stage.

Figure 5A:
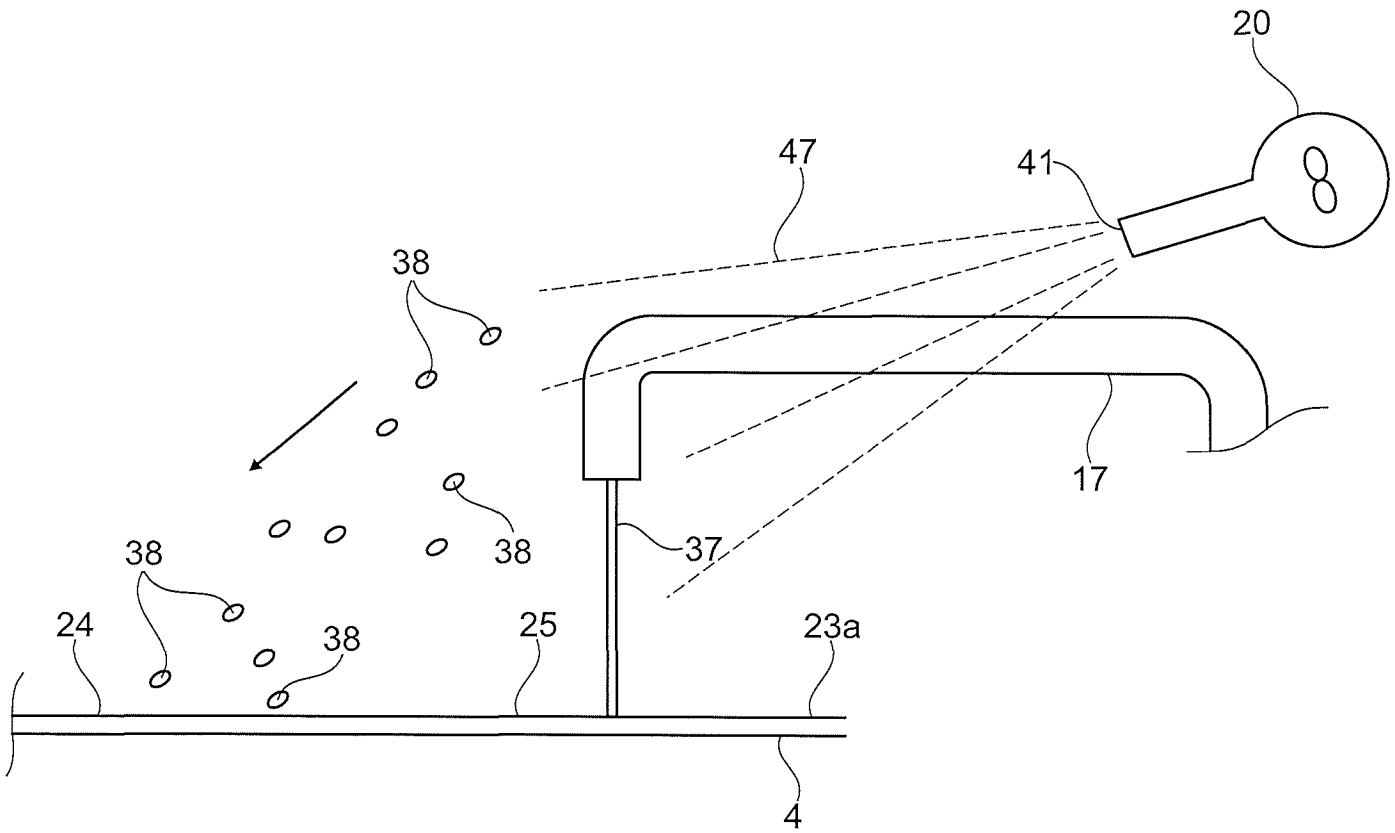
FIG. 5*a* is a figure similar to FIG. 3 and FIG. 4 illustrating the solution to the technical problem.

As can be seen in FIG. 5*a*, the blowing device 20 has an outlet (an exit opening) 41 and air or gas is ejected in a stream out from the outlet 41 and toward the remaining part 24 of the web W. The outlet 41 is located at the tip of a nozzle which is designed such that the air or gas that is ejected from the blowing device is ejected in a stream 47 which is shaped as a cone the diameter of which is expanding as the stream 47 moves away from the outlet (exit opening) 41. The cone-shaped stream 47 is capable of reaching both the water jet cutting device 17 and the area between the water jet cutting device 17 and the web W. In this way, the build-up of lumps DL of fibrous particles on the water jet cutting device 17 can be effectively counter-acted.

Figure 5B:
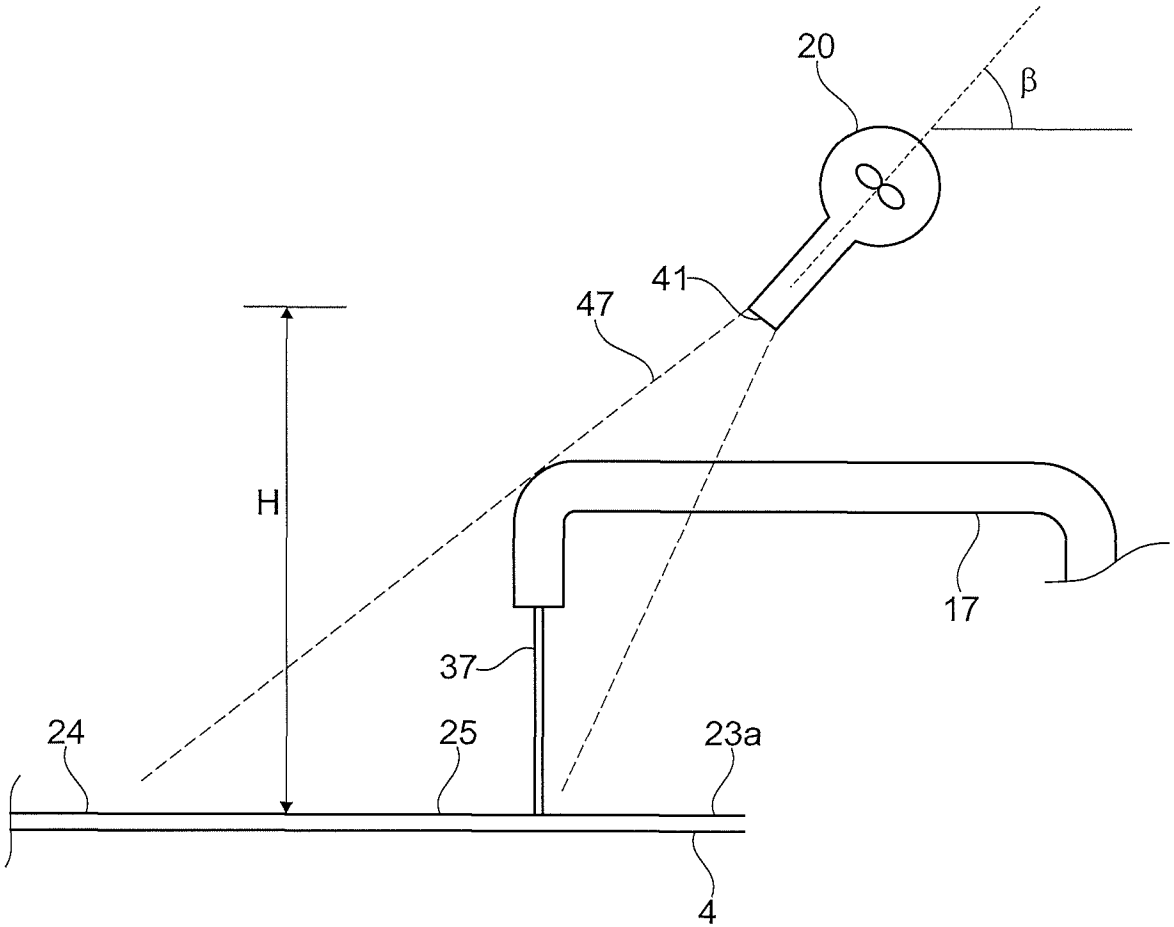
FIG. 5*b* is a figure similar to FIG. 5*a* but illustrating some aspects in greater detail.
Figure 5C:
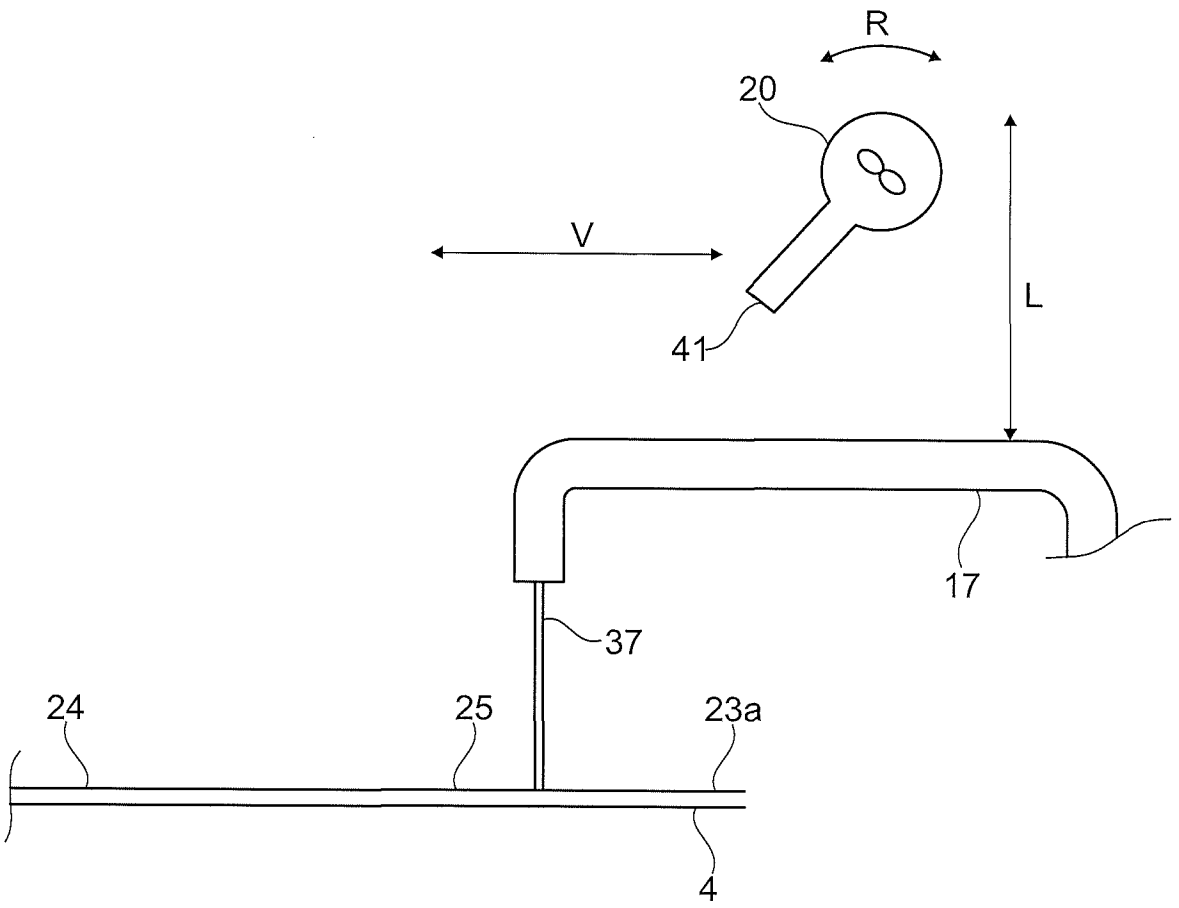
FIG. 5 *c* is similar to FIGS. 5*a* and 5*b* but shows another aspect.
FIG. 5*d* is a view from above illustrating further aspects of the invention.

As can be seen in FIG. 5*a*, the blowing device 20, 21 may be placed such that the outlet 41 is located at a higher level than the water jet cutting device 19. The outlet 41 of the blowing device 20 is preferably also so placed in the cross-machine direction CD of the machine that it is outside the point where the water jet 37 cuts the web W (i.e. it is either placed outside the edge of the wire or at least closer to the edge of the wire than the point where the water jet 37 cuts the web). With further reference to FIG. 5*b*, the outlet 41 is placed at a height H above the fibrous web and the outlet 41 of the blowing device 20 is oriented at an angle β relative to a horizontal plane. In preferred embodiments, the angle β can be varied such that the angle with which the stream 47 of air or gas is ejected toward the blowing device 20, 21, 22 can be varied. As symbolically indicated by arrow R in FIG. 5*c*, the blowing device 20 may be turned/rotated such that the angle β can be varied such that the stream 47 of air or gas can be adjusted to optimize the effect of the stream 47 of air or gas and/or to adapt to varying operating conditions. As symbolically indicated in FIG. 5*c* by arrows V and L, the blowing device 20 may be moved horizontally in the direction of arrow V and vertically in the direction of arrow L. While embodiments are conceivable in which the blowing device 20 is in a fixed position, the blowing device 20 is preferably mounted such that it can be rotated or moved in the direction of arrows V and L to optimize the effect of the stream 47 of air or gas and/or to adapt to varying operating conditions. In this context, the expression "varying operating conditions" may include, for example, different machine speeds, different basis weight of the fibrous web, intensity of the cutting action of the water jet cutting device and the distance between the water jet cutting device and the fibrous web.

Figure 5D:
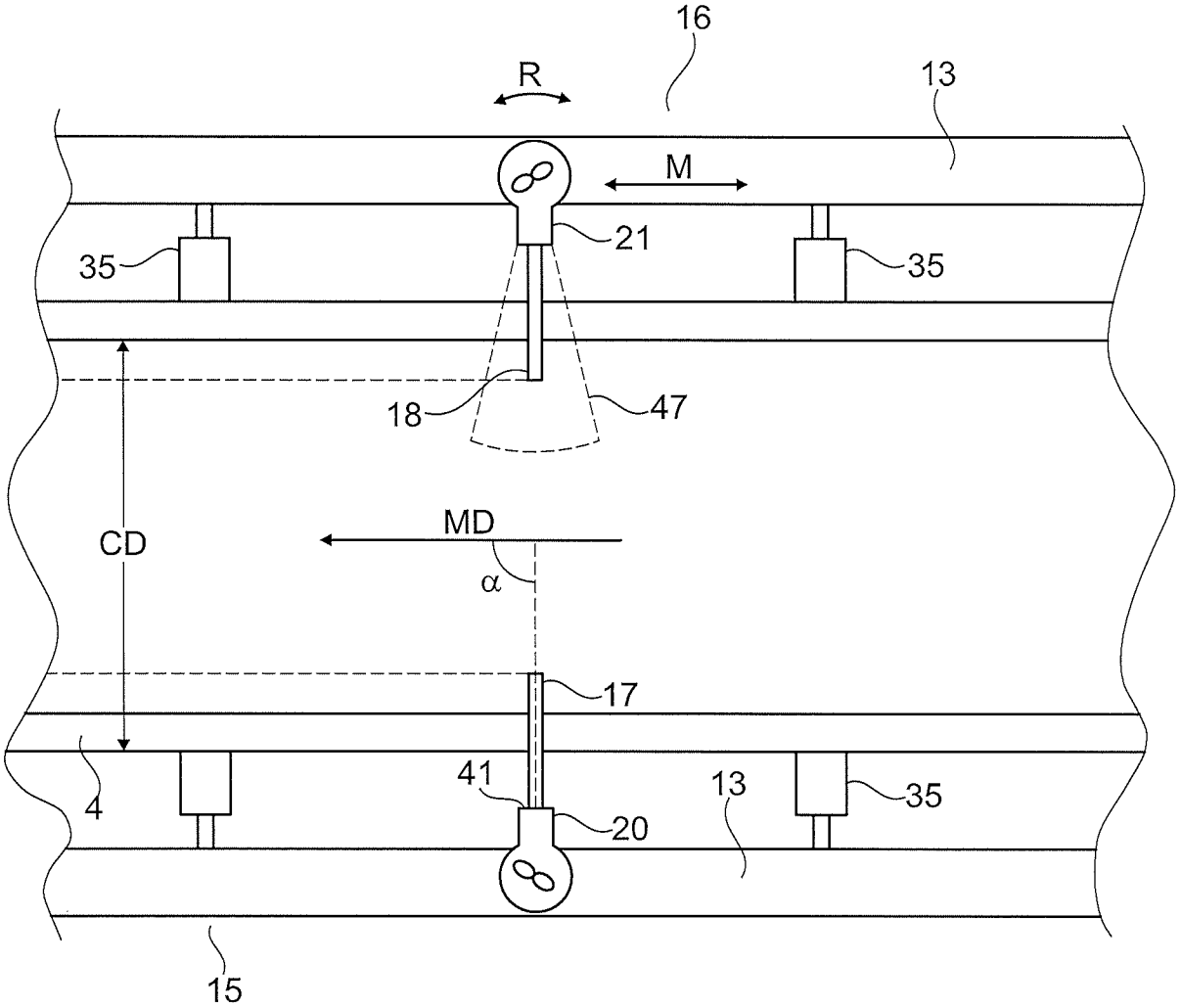

With reference to FIG. 5*d*, it can be seen that the blowing devices 20, 21, are directed at an angle α to the machine direction MD. This angle is preferably 90° or about 90°. However, in preferred embodiments of the invention, the angle α can be varied. As symbolically indicated by the arrow R in FIG. 5*d*, each blowing device is preferably arranged such that it can be turned such that the angle α can be adjusted. While embodiments are conceivable in which the angle α is fixed, it is preferable that the angle α is adjustable. For this reason, the blowing devices 20, 21, are preferably mounted such that the angle α to the machine direction can be adjusted. In this way, it is possible to adjust the way that the stream 47 of air or gas that is ejected from a blowing device 20, 21, hits the water jet cutting device such that the stream 47 of air or gas can be adapted to varying conditions, i.e. such that the effect of the stream 47 of air or gas can be optimized for varying operating conditions. As symbolically indicated by arrow M, the blowing devices 20, 21 may be mounted to be movable in the machine direction MD such that the position of the blowing devices 20, 21 may be varied to adapt to varying operating conditions. In this context, the expression "varying operating conditions" may include, for example, different machine speeds, different basis weight of the fibrous web, intensity of the cutting action of the water jet cutting device and the distance between the water jet cutting device and the fibrous web.

From what has been explained above, it can thus be understood that, in preferred embodiments, the angle α, β at which the nozzle of the blowing device 20, 21, 22 (and its exit opening 41) points to the water jet cutting device may be varied, preferably in both a horizontal plane and a vertical plane. Thereby, also the direction of the stream 47 of air or gas toward the water jet cutting device 17, 18 19 can be varied to optimize the dust-preventing effect of the blowing device 20, 21, 22 according to varying operating conditions. Embodiments are conceivable in which only the angle in the horizontal plane or the angle in the vertical plane is adjustable, but it is preferred that they are both adjustable. In preferred embodiments of the invention, the position of the blowing device 20, 21 (and thereby also the position of the exit opening 41) can be varied by moving the blowing device horizontally in the cross-machine direction CD and/or the machine direction MD as indicated by arrows V and M (see FIGS. 5*c* and 5*d*) and/or by moving the blowing device vertically as indicated by arrow L in FIG. 5*c*.

The invention can be applied at only one edge of the fibrous web W but in preferred embodiments, the invention is used on both edges of the fibrous web when the invention is applied in connection with edge trimming. An advantageous embodiment will now be explained with reference to FIG. 6. As shown in FIG. 6, the paper making machine 1 comprises a first water jet cutting device 17 which is placed in the forming section adjacent the first side 15 of the frame 13 and arranged to cut a narrow edge strip 23*a* from the fibrous web W and the paper making machine 1 further comprises a second water jet cutting device 18 which is placed in the forming section 2 adjacent the second side 16 of the frame 13 and arranged to cut a narrow edge strip 23*b* from the fibrous web W. This means that, at the edges of the fibrous web W, two edge strips 23*a*, 23*b* can be separated from a remaining part 24 of the fibrous web W which remaining part 24 is located between the edge strips 23*a*, 23*b*. It should be understood that the remaining part 24 of the fibrous web W and is wider than the two edge strips 23*a*, 23*b* together (normally, it is significantly wider than the two edge strips 23*a*, 23*b* together). In this embodiment, the paper making machine 1 comprises a blowing device 20, 21 for each of the first 17 and the second 18 water jet cutting device and the blowing devices 20, 21 are arranged to blow gas or air against their respective water jet cutting device 17, 18 in a direction toward the remaining part 24 of the fibrous web W such that fiber particles that have been released by the cutting action of the water jet cutting devices 17, 18 are blown onto the surface of the remaining part 24 of the fibrous web W and follow the remaining part 24 of the fibrous web along the predetermined path P.

As explained with reference to FIG. 1, the paper making machine 1 may optionally comprise a through air drying cylinder 7 and a foraminous wire 6. The foraminous wire 6 is then arranged to run in a loop in a path which partially goes over a part of an outer circumference of the through air drying cylinder 7. The inner forming fabric of the forming section 2 is then arranged to transfer the fibrous web W (or at least the remaining part 24 of it after edge cutting). The first and second water jet cutting devices 17, 18 may then be arranged to act on the fibrous web W as the fibrous web W travels on the forming fabric 4 and the forming fabric 4 will then carry the remaining part 24 of the fibrous web W to the foraminous wire 6 after the water jet cutting devices 17, 18 have acted on the fibrous web W. The paper making machine 1 is then configured to transfer the remaining part 24 of the fibrous web W onto the foraminous fabric 6 and to guide the edge strips 23*a*, 23*b* away from the predetermined path P, either in connection with transfer of the remaining part 24 to the foraminous fabric 6 or at a later point. The remaining part 24 of the fibrous web W will be transferred to the foraminous wire 6 such that the surface of the major portion onto which fiber particles have been blown comes into contact with the foraminous wire 6.

With reference to FIG. 6, it should be understood that, on each side 15, 16 of the frame, more than one water jet cutting device 17, 18 for edge trimming may be used. Optional further water jet cutting devices 17', 18' are indicated with broken lines.

Figure 8:
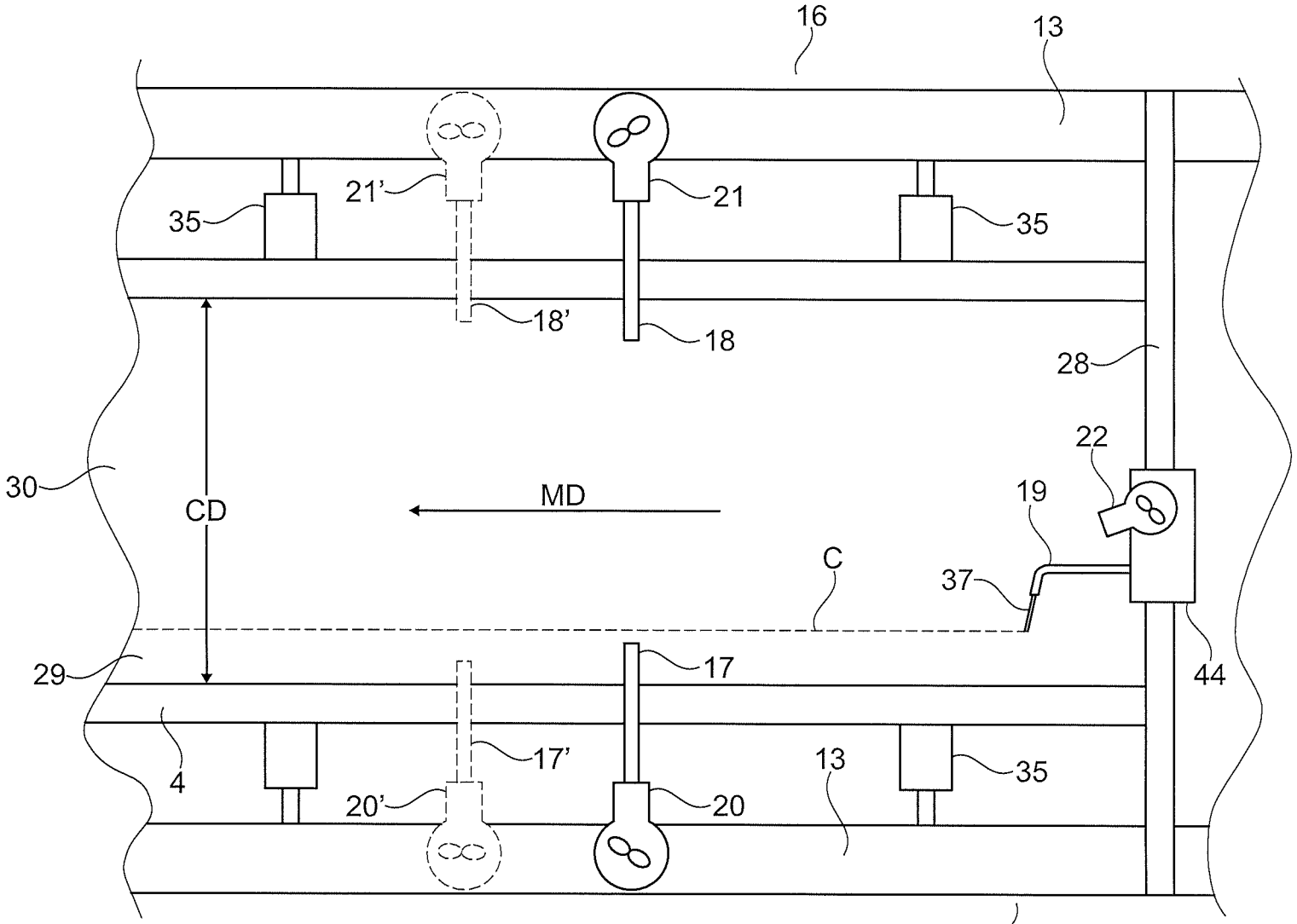
FIG. 8 is a figure similar to FIG. 6 illustrating how the invention can be applied for tail threading purposes.

The invention is not necessarily intended only for edge trimming but can also be applied in connection with tail threading. With further reference to FIG. 6 and to FIG. 8, the paper making machine 1 may comprise a moveable water jet cutting device 19 that is capable of moving in the cross-machine direction CD such that a tail 29 can be cut from the fibrous web W for the purpose of threading. In the embodiment of FIG. 6, a carriage 44 is arranged to be moveable on a support beam 28 in the direction of arrow X. The support beam 28 extends in the cross-machine direction CD such that movement of the carriage 44 in the direction of arrow X will move the carriage 44 to different positions in the cross-machine direction. A water jet cutting device 19 is mounted on the carriage 44 such that it is moveable in the cross-machine direction CD. As can be seen in FIG. 8, the moveable water jet cutting device 19 can direct a water jet 37 against the fibrous web W such that the fibrous web is divided along a line of cut C into a narrow tail 29 and a remaining part 30. The paper machine is then arranged to convey the tail 29 further in the machine direction MD along the predetermined path P while the rest of the fibrous web W (i.e. the remaining part 30) is directed away from the predetermined path P. A blowing device 22 is arranged to blow gas or air against the moveable water jet cutting device 19 in a direction toward the tail 29 such that fiber particles that have been released by the cutting action of the water jet cutting device 19 are blown onto the surface of the tail 29 and follow the tail 29 along the predetermined path P. The blowing device 22 that is arranged to act against the moveable water jet cutting device 19 is also moveable in the cross-machine direction CD and it may conceivably be mounted on the same carriage 44 as the moveable water jet cutting device 19. Alternatively, the blowing device 22 may be moveable on a carriage of its own and perhaps on a support beam of its own. However, movement of the blowing device 22 must of course be synchronized with the movement of the moveable water jet cutting device 19.

Figure 10:
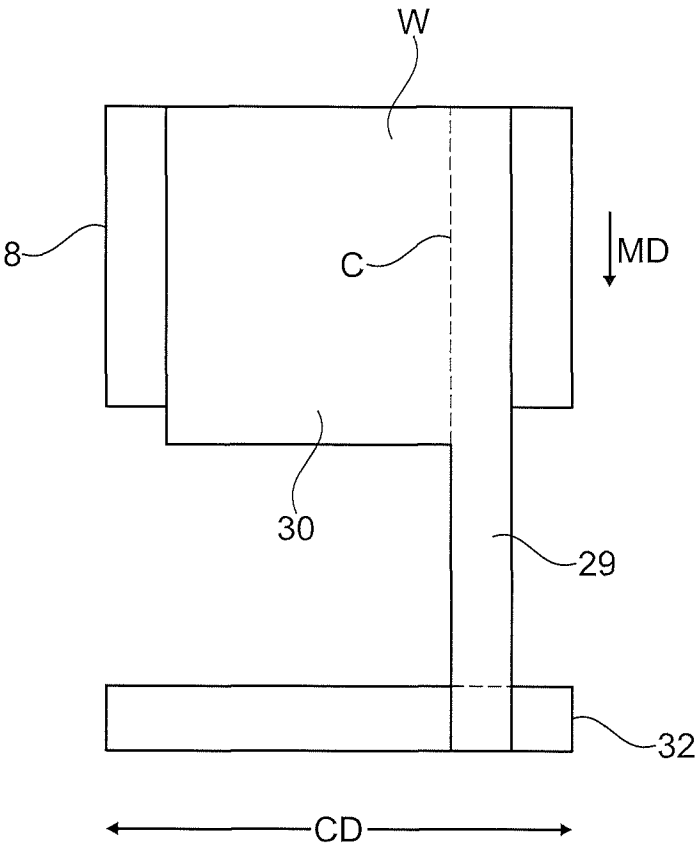
FIG. 10 is a figure similar to FIG. 9 and showing a first part of a tail threading procedure.
Figure 9:
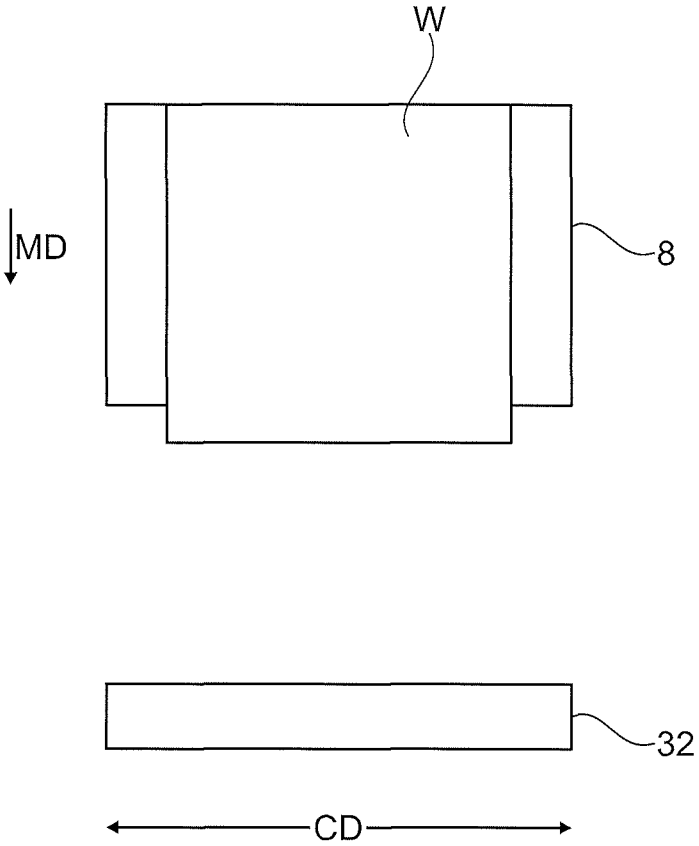
FIG. 9 is a view from above illustrating a situation in which tail threading is required.
Figure 12:
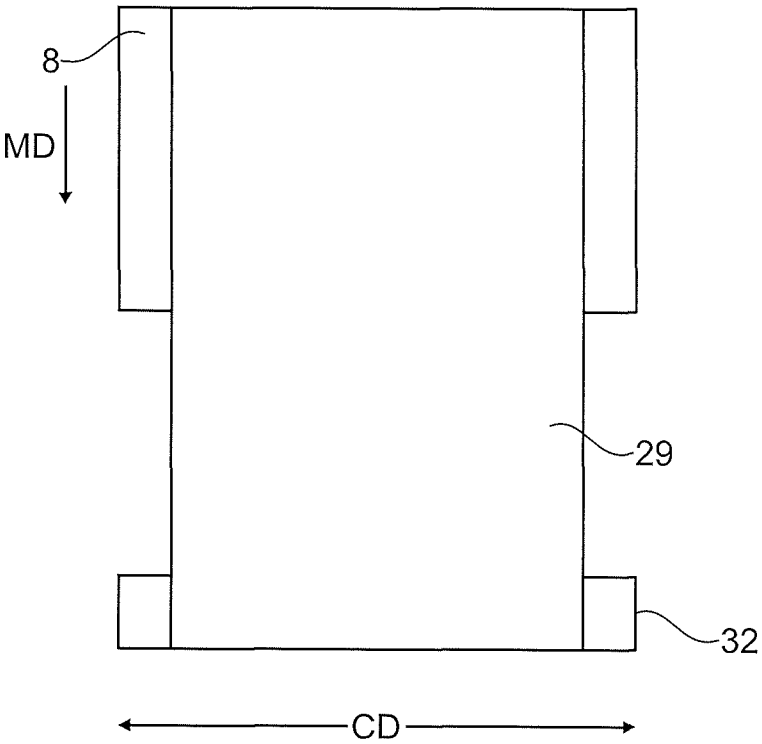
FIG. 12 is a figure similar to FIGS. 9-11 and showing the end of a tail threading procedure.
Figure 11:
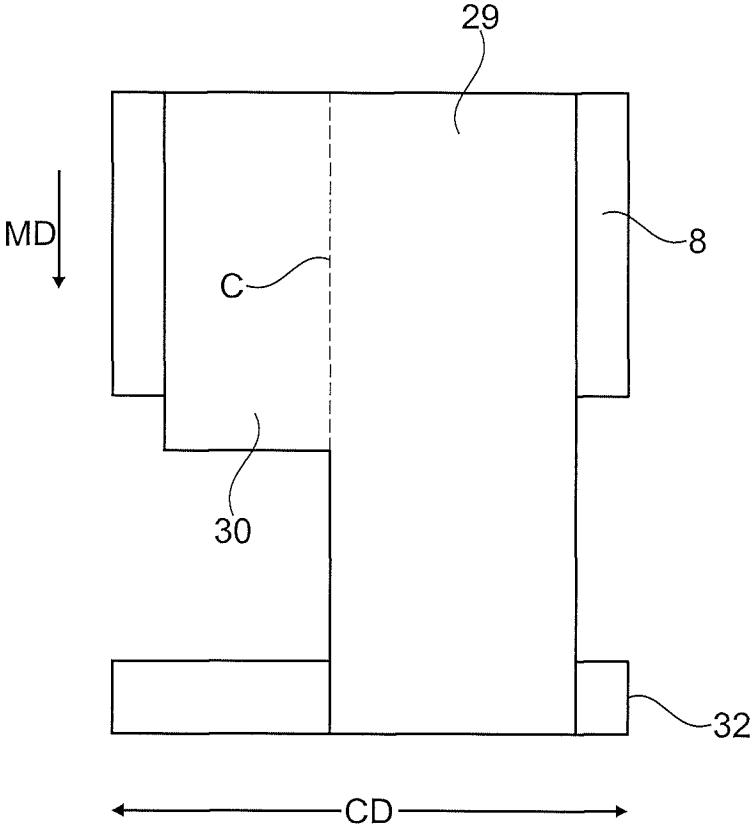
FIG. 11 is a figure similar to FIG. 10 and showing a later part of the tail threading procedure.

A possible example of a threading sequence will now be explained with reference to FIGS. 9, 10, 11 and 12. Initially, the fibrous web W is travelling along the predetermined path P. A web break occurs and the fibrous web W may be directed downwards after the Yankee drying cylinder 8, see FIG. 9. A tail 29 which is initially quite narrow is cut by means of the moveable water jet cutting device 19 and the narrow tail 29 is passed onto the reel-up 11 and is caused to adhere to the core shaft 32 as can be seen in FIG. 10. Glue can be used to make the tail 29 adhere to the core shaft 32. The remaining part 30 can be sent downwards into the pulper (see also FIG. 1). The moveable water jet cutting device 19 is now moved in the cross-machine direction such that the tail 29 becomes wider and the remaining part 30 which is a waste part of the fibrous web becomes narrower as can be seen in FIG. 11. Finally, the moveable water jet cutting device is moved all the way to the opposite end from which it started such that the tail 29 achieves full width as shown in FIG. 12. At this point, the remaining part 30 has completely vanished.

The tail threading procedure has been described above with reference to a case where the tail 29 is caused to wind directly on the core shaft 32 but the same procedure can be used to thread the tail 29 to an already existing roll 12 which has not yet been wound to its full diameter.

The water jet cutting device 19 that has been explained with reference to FIGS. 6-12 is mounted on a carriage 44 which is moveable on a support beam 28 that extends in a cross-machine direction CD that is perpendicular to the machine direction MD. In this way, the water jet cutting device 19 is capable of moving in the cross-machine direction CD and the blowing device 22 is also moveable in the cross-machine direction in a movement that is synchronized with the movement of the water jet cutting device 19. This principle can be used independently of the shape of the stream 47 of air or gas that is ejected from the blowing device 22 and for nozzles of different design. However, a circular cylindrical or conical expanding shape for the stream 47 of air or gas is preferred and it is preferred that the nozzle is designed to create such a stream of air or gas. By having a movable water jet cutting device 19 and a blowing device 22 that can move in a movement that is synchronized with the movement of the water jet cutting device, the advantage is obtained that a narrow tail can be cut while the blowing device counteracts the formation of lumps of paper fibers that may fall on the narrow tail and thus disturb the tail threading operation.

Different kinds of blowing devices 20, 21, 22 can be used. However, in preferred embodiments of the invention, at least one of the blowing devices is an air amplifier and preferably all the blowing devices used are air amplifiers. The function of an air amplifier is shown schematically with reference to FIG. 7. A blowing device 17 can have an inlet 39 that leads to an annular chamber 42. From the annular chamber 42, air can pass through an annular opening into the inner part of the air amplifier over a Coanda surface 43. When pressurized air is sent into the air amplifier through the inlet 39, it will first reach the annular chamber 42 and then continue into the hollow interior of the air amplifier. The Coanda surface 43 will guide the air in a direction to the right in FIG. 7. A rear opening 40 of the air amplifier leads into the hollow interior of the air amplifier and the air coming from the annular chamber 42 will generate an underpressure that drags air from the open rear part 40 and in a direction to the right in FIG. 7 as indicated by the arrows. An amplified air stream will then move through the nozzle 48 and exit through the front opening 41 (the exit opening of the air amplifier) and can be directed toward a water jet cutting device 17, 18, 19. In the embodiment shown in FIG. 7, the nozzle 48 and its exit opening 41 is shaped to create a cone-shaped air stream that expands in the direction away from the exit opening (41). In this context, the expression "cone-shaped" should be understood as referring to the shape of a conical frustum since the stream 47 of air or gas will have a certain diameter already when it leaves the exit opening 41. The pressurized air fed to the annular chamber 42 may suitably have a pressure on the order of about 6 bar but other pressure levels may also be used. Suitable air amplifiers are sold by, for example, Nex Flow Air Products Corp., 10520 Yonge Street, Richmond Hill, Ontario, Canada (Web: www.nexflow.com or www.nexflowair.com). By means of an air amplifier, it is possible to create a stream of air that is shaped as a cone that expands in the direction away from the exit opening 41. Preferably, the stream of air has a diameter of at least 4 centimeters as it leaves the exit opening and even more preferred a diameter of at least 5 centimeters. For example, the stream of air may have a diameter in the range of 4-10 centimeters as it leaves the exit opening 41. The distance from the exit opening 41 to the point where the water jet 37 hits the fibrous web W may be in the range of 0.3 m-1.2 m in many practical applications.

The shape of the stream 47 of air or gas is preferably conical and expanding in the direction away from the exit opening 41 but a stream 47 which has a circular cylindrical shape can also be used and the nozzle 48 may thus be designed also to create a stream 47 which is circular cylindrical or substantially circular cylindrical.

In many practical applications, the volume flow of air or gas from one blowing device 20, 21, 22 may be in the range of 17 $m^3$/h-90 $m^3$/h in order to achieve a good effect.

Since the invention makes use of an air stream that is either circular cylindrical or conical and expanding, both the water jet cutting device 17, 18, 19, the part of the web W where cutting takes place and the area between the water jet cutting device 17, 18, 19 and the fibrous web will be covered by the stream 47 of air or gas. This results in an effective removal of fibrous particles that could otherwise form lumps on the water jet cutting device or other parts of the machine.

It will now be understood that the invention can be described also in terms of a method of cutting a fibrous web W by means of at least one water jet cutting device 17, 18, 19 and blow gas or air toward the water jet cutting device 17, 18, 19 in a direction toward a part 24, 29 of the fibrous web W that remains after edge trimming or tail cutting such that fiber particles that have been released by the cutting action of the water jet cutting device 17, 18, 19 are blown onto the surface of the remaining part 24, 29 of the fibrous web W and follow the remaining part 24, 29 fibrous web W along the predetermined path P.

Thanks to the invention, the problem that lumps of fiber particles fall on the web and cause difficulties in the paper making process can be eliminated or at least significantly reduced. This improves the reliability of the machine operation.

It should be understood that embodiments of the inventive machine and the inventive method are conceivable in which the invention is used only in connection with edge trimming or only in connection with tail threading. However, in preferred embodiments, the inventive idea of using blowing devices against the water jet cutting devices are used both for edge trimming and tail threading.

While the embodiments disclosed show water jet cutting only in the forming section, it should be understood that the invention may also be used in other parts of the machine. However, it is believed that the most advantageous way of using the invention is precisely in the forming section.

Although an embodiment has been shown that includes both a through-air drying unit 45 and a Yankee drying cylinder 8, embodiments with only through-air drying are conceivable as well as embodiments with a Yankee drying cylinder 8 but no through-air drying unit. The paper making machine may optionally also include a press, for example a shoe press and a shoe press can be used in any machine making use of the invention and in different combinations of fabrics (felts, wires, transfer belts with a smooth or textured surface etc). Moreover, the invention can also be applied to other paper making machines than tissue machines. It should be understood that the invention is applicable to any tissue making process in which water jet cutting devices are used and the invention can be used with any combination of machine clothing/fabrics (e.g. press felts, transfer belts, metal belts and wires).

It should be understood that all figures are schematic/symbolic and only intended to show the general principles underlying the invention and that the figures are not to be understood as realistic manufacturing drawings.

It should also be understood that, when the invention is used for tail threading, this does not have to be because of a web break, it could also be in connection with start-up of the machine.

If the invention is used for a tissue paper making machine, the width of the machine in the cross-machine direction CD (as defined by the width of the Yankee drying cylinder) may typically be in the range of 3 m-6.5 m but other machine widths are also conceivable. For example, machine width may be 7 m or 8 m. For a tissue machine using the invention, the machine speed may be in the range of 1200 m/min-2200 m/min. For example, the machine speed may be 1700 m/min or 1900 m/min but other values for machine speed are also conceivable. Generally speaking, there is a tendency to increased machine speeds and it is conceivable that the invention may one day be applied to machines running at speeds of 2400 m/min or even higher. Likewise, the machine could very well be running at speeds lower than 1200 m/min.

The cutting action performed by the water jet cutting devices 17, 18, 19 may advantageously be performed in the forming section 2 where the fibrous web is supported by the forming fabric 4 which can be a wire with a woven plastic mesh or a woven wire mesh such as a bronze or stainless-steel mesh but the forming fabric 4 may also be a felt. When cutting is performed in the forming section 2, the fibrous web W is still very wet, and it is therefore weak and a supporting fabric is usually necessary. A support for a wet fibrous web may also be formed by a polymer belt (for example a rubber belt) which may be solid or permeable. The cutting of the fibrous web W may also be performed in an open draw, i.e. without any support for the fibrous web. If the fibrous web W is cut (for edge trimming or threading) in an open draw, this should preferably not be done before the fibrous web W has reached a relatively high dryness such that the fibrous web W has the necessary strength for cutting without support. If the fibrous web W is cut in an open draw, the dryness should preferably be at least 90%.

In FIG. 6 and FIG. 8, the water jet cutters 17, 18 for edge trimming are shown as being located downstream (in the machine direction MD) of the water jet cutter 19 which is used for cutting a tail 29. This would be the most common arrangement, but embodiments are conceivable in which the water jet cutter 19 is located downstream of the water jet cutters 17, 18 for edge trimming.

By using a blowing device with an nozzle that is designed to a create a circular cylindrical or cone-shaped stream 47 of air or gas toward the water jet cutting device 17, 18, 19 and by sending a circular cylindrical or cone-shaped stream 47 of air or gas toward the water jet cutting, it is possible to effectively prevent the build-up of lumps of fiber material on the water jet cutting device(s) and other parts of the paper making machine from which such lumps may fall on the fibrous web and case problems. Instead of using a thin layer of air, the invention makes use of a stream 47 of air that is circular cylindrical or conical and expanding and which acts on both the water jet cutting device 17, 18, 19, the fibrous web W and the area between the water jet cutting device and the fibrous web. The stream of air can thus engulf an entire area that encompasses not only a part of the space between the nozzle of the water jet cutting device and the fibrous web but also the part of the fibrous web where the water jet cuts and also the water jet cutting device itself or at least parts of it. The stream of air covers a volume in which both the water jet cutting device (or parts of it), the area where the water jet cutting device acts on the fibrous web and the space between the nozzle of the water jet cutting device and the fibrous web While the invention has been described above with reference to a paper making machine and a method, it should be understood that these categories (machine and method) only reflect different aspects of one and the same invention. The inventive method may thus comprise such steps that would be the inevitable result of using the inventive machine (or embodiments thereof). In the same way, the inventive machine may comprise means for performing steps that have been disclosed as being part of the inventive method.

The invention may also be defined in terms of a method of rebuilding or upgrading/improving an already existing machine that has water jet cutting devices by adding/mounting blowing devices that are designed and mounted in accordance with the present invention.

The invention claimed is:

1. A paper making machine (1) comprising:

a forming section (2) in which a fibrous web (W) can be formed;

a drying section (5) in which a formed fibrous web (W) can be dried;

a reel-up (11) on which a dried fibrous web (W) can be wound into a roll (12);

at least one water jet cutting device (17, 18, 19); and at least one blowing device (20, 21, 22) configured to blow gas or air in an area of the at least one water jet cutting device (17, 18, 19), wherein:

a machine direction (MD) is defined as the direction from the forming section (2) toward the reel-up (11) and the paper making machine (1) is configured to carry a fibrous web (W) in the machine direction (MD) along a predetermined path (P), the at least one water jet cutting device (17, 18, 19) is configured to cut the fibrous web (W) that is moving in the machine direction (MD) such that the fibrous web (W) is divided into at least one waste part (23*a*, 23*b*, 30) and a remaining part (24, 29), the paper making machine (1) is configured to direct the at least one waste part (23*a*, 23*b*, 30) away from the predetermined path (P) and to convey the remaining part (24, 29) further in the machine direction (MD) along the predetermined path (P), the at least one blowing device (20, 21, 22) is configured to blow the gas or air against the water jet cutting device (17, 18, 19) in a direction toward the remaining part of the fibrous web (24, 29) such that fiber particles that have been released by the cutting action of the water jet cutting device (17, 18, 19) are blown onto the surface (25) of the remaining part (24, 29) of the fibrous web (W) and follow the remaining part (24, 29) of the fibrous web along the predetermined path (P), the at least one blowing device (20, 21, 22) comprises a nozzle with an exit opening (41) through which the air or gas is ejected in a stream (47), the nozzle being oriented at an angle (α) relative to the machine direction (MD) such that the stream (47) of air or gas that is blown out of the exit opening (41) is directed in its entirety at an angle to the machine direction (MD), and the nozzle of the at least one blowing device (20, 21, 22) is configured to a create a circular cylindrical or cone-shaped stream (47) of air or gas toward the water jet cutting device (17, 18, 19).

2. The paper making machine (1) according to claim 1, wherein the paper making machine (1) further comprises:

a frame (13) configured to support rolls (35) that extend from a first side (15) of the paper making machine (1) to a second side (16) of the machine (1) in a cross-machine direction (CD) that is perpendicular to the machine direction (MD), and a first water jet cutting device (17) positioned in the forming section adjacent the first side of the frame and configured to cut a narrow edge strip (23*a*) from the fibrous web (W), a second water jet cutting device (18) positioned in the forming section (2) adjacent the second side (16) of the frame (13) and configured to cut a narrow edge strip (23*b*) from the fibrous web (W) such that, at the edges of the fibrous web (W), two edge strips (23*a*, 23*b*) are separated from a remaining part (24) of the fibrous web (W) which remaining part (24) is located between the edge strips (23*a*, 23*b*) and is wider than the two edge strips (23*a*, 23*b*) together, wherein the at least one blowing device (20, 21, 22) comprises a first blowing device (20) for the first (17) water let cutting device and a second blowing device (21) for the second (18) water jet cutting device, the first and second blowing devices (20, 21) being configured to blow gas or air against their respective water jet cutting device (17, 18) in a direction toward the remaining part (24) of the fibrous web (W) such that fiber particles that have been released by the cutting action of the water jet cutting devices (17, 18) are blown onto the surface of the remaining part (24) of the fibrous web (W) and follow the remaining part (24) of the fibrous web along the predetermined path (P).

3. The paper making machine (1) according to claim 2, wherein:

the paper making machine (1) comprises a through air drying cylinder (7) and a foraminous wire (6) configured to run in a loop in a path which partially goes over a part of an outer circumference of the through air drying cylinder (7), the forming section (2) of the paper making machine comprises a forming fabric (4) and the first and second water jet cutting devices (17, 18) are configured to act on the fibrous web (W) as the fibrous web (W) travels on the forming fabric (4), the forming fabric (4) is configured to carry the remaining part (24) of the fibrous web (W) to the foraminous wire (6) after the water jet cutting devices (17, 18) have acted on the fibrous web (W), the paper making machine (1) is configured to transfer the remaining part (24) of the fibrous web (W) onto the foraminous fabric (6) and to guide the edge strips (23*a*, 23*b*) away from the predetermined path (P), and the remaining part (24) of the fibrous web (W) is transferred to the foraminous wire (6) such that the surface of the major portion onto which fiber particles have been blown comes into contact with the foraminous wire (6).

4. The paper making machine (1) according to claim 1, wherein:

the paper making machine (1) comprises a moveable water jet cutting device (19) that is capable of moving in a cross-machine direction (CD) that is perpendicular to the machine direction (MD) such that a tail (29) can be cut from the fibrous web (W) for the purpose of threading, the paper making machine (1) is configured to convey the tail (29) further in the machine direction (MD) along the predetermined path (P) while the rest of the fibrous web (W) is directed away from the predetermined path (P), and the at least one blowing device comprises a first blowing device (22) configured to blow gas or air against the moveable water jet cutting device (19) in a direction toward the tail (29) such that fiber particles that have been released by the cutting action of the water jet cutting device (19) are blown onto the surface of the tail (29) and follow the tail (29) along the predetermined path (P).

5. The paper making machine according to claim 1, wherein the at least one blowing device (20, 21, 22) is an air amplifier.

6. The paper making machine according to claim 1, wherein the position of the at least one blowing device (21, 21, 22) relative to at least one of the water jet cutting device (17, 18, 19) or the angle (α, β) at which the nozzle of the at least one blowing device (20, 21, 22) together with its exit opening (41) is directed toward the at least one blowing device (20, 21, 22) is/are adjustable.

7. A method of cutting a fibrous web (W) which is running along a predetermined path in a paper making machine (1) in a machine direction (MD) from a forming section (2) in which the fibrous web (W) is formed toward a reel-up (11) where the fibrous web (W) is wound to a roll (12) after it has been dried, the method comprising:

cutting the web by means of a water jet cutting device (17, 18, 19) such that the fibrous web (W) is divided into at least one waste part (23*a*, 23*b*, 30) and a remaining part (24, 29) which waste part (23*a*, 23*b*, 30) is directed away from the predetermined path and which remaining part (24, 29) is conveyed further in the machine direction (MD) along the predetermined path (P); and blowing air or gas in the area of the water jet cutting device (17, 18, 19) and toward the water jet cutting device (17, 18, 19), the air or gas that is blown in the area of the water jet cutting device (17, 18, 19) being blown in a direction toward the remaining part (24, 29) of the fibrous web (W) such that fiber particles that have been released by the cutting action of the water jet cutting device (17, 18, 19) are blown onto the surface of the remaining part (24, 29) of the fibrous web (W) and follow the remaining part (24, 29) of the fibrous web (W) along the predetermined path (P), the air or gas being blown toward the water jet cutting device (17, 18, 19) in a stream of air or gas which in its entirety is directed at an angle to the machine direction (MD), wherein the stream of air or gas is given a shape which is circular cylindrical or conical and expanding in the direction in which the stream moves.

8. The method according to claim 7, wherein:

the paper making machine (1) further comprises a frame (13) that is configured to support rolls (35) that extend from a first side (15) of the paper making machine (1) to a second side (16) of the machine (1) in a cross-machine direction (CD) that is perpendicular to the machine direction (MD), a first water jet cutting device (17) positioned in the forming section (2) adjacent the first side of the frame (13) is used to cut a narrow edge strip (23*a*) from the fibrous web (W), a second water jet cutting device (18) positioned in the forming section (2) adjacent the second side (16) of the frame (13) is used to cut a narrow edge strip (23*b*) from the fibrous web (W) such that, at the edges of the fibrous web (W), two edge strips (23*a*, 23*b*) are separated from a remaining part (24) of the fibrous web (W) which remaining part (24) is located between the edge strips (23*a*, 23*b*) and is wider than the two edge strips (23*a*, 23*b*) together, and gas or air is blown against each of the first (17) and the second (18) water jet cutting device in a direction toward the remaining part (24) of the fibrous web (W) such that fiber particles that have been released by the cutting action of the water jet cutting devices (17, 18) are blown onto the surface of the remaining part (24) of the fibrous web (W) and follow the remaining part (24) of the fibrous web (W) along the predetermined path (P).

9. The method according to claim 8, wherein:

the paper making machine (1) comprises a through air drying cylinder (7) and a foraminous wire (6) is running in a loop along a path which partially goes over a part of an outer circumference of the through air drying cylinder (7), the forming section (2) of the paper making machine (1) comprises a forming fabric (4) and the first and second water jet cutting devices (17, 18) act on the fibrous web (W) as the fibrous web (W) travels on the forming fabric, the forming fabric (4) carries the remaining part (24) of the fibrous web (W) to the foraminous wire (6) after the water jet cutting devices (17, 18) have acted on the fibrous web (W), and the remaining part (24) of the fibrous web (W) is transferred onto the foraminous fabric (6) and the edge strips (23*a*, 23*b*) are guided away from the predetermined path (P) and the remaining part (24) of the fibrous web (W) is transferred to the foraminous wire (6) such that the surface of the remaining part (24) onto which fiber particles have been blown comes into contact with the foraminous wire (6).

10. The method according to claim 7, wherein:

a water jet cutting device (19) that is moveable in the cross-machine direction is used to cut a tail (29) from the fibrous web (W) for the purpose of threading, the tail (29) is conveyed further in the machine direction (MD) along the predetermined path (P) while the rest of the fibrous web (W) forms a waste part that is directed away from the predetermined path (P), and gas or air is blown against the moveable water jet cutting device (19) in a direction toward the tail (29) such that fiber particles that have been released by the cutting action of the water jet cutting device (19) are blown onto the surface of the tail (29) and follow the tail (29) along the predetermined path (P).

* * * * *